US010420431B1

(12) United States Patent
Speciale et al.

(10) Patent No.: US 10,420,431 B1
(45) Date of Patent: Sep. 24, 2019

(54) OVERGARMENT WITH AN ELEVATED MARSUPIAL POCKET

(71) Applicant: Cozy Comfort Company LLC, Cave Creek, AZ (US)

(72) Inventors: Brian Speciale, Cave Creek, AZ (US); Michael Speciale, Cave Creek, AZ (US)

(73) Assignee: Cozy Comfort Company LLC, Cave Creek ( * ) Notice: Subject to any disclaimer, the term of this patent is extended or adjusted under 35 U.S.C. 154(b) by 0 days.

(21) Appl. No.: 16/130,502

(22) Filed: Sep. 13, 2018

Related U.S. Application Data

(60) Provisional application No. 62/558,136, filed on Sep. 13, 2017, provisional application No. 62/671,417, filed on May 14, 2018.

(51) Int. Cl.

| | |
|---|---|
| ***A41D 27/00*** | (2006.01) |
| ***A47G 9/06*** | (2006.01) |
| ***A41D 27/10*** | (2006.01) |
| ***A41D 31/02*** | (2019.01) |
| ***A41D 27/20*** | (2006.01) |
| ***A41D 3/00*** | (2006.01) |

(52) U.S. Cl.
CPC ..... *A47G 9/064* (2013.01); *A41D 3/005* (2013.01); *A41D 27/10* (2013.01); *A41D 27/20* (2013.01); *A41D 31/02* (2013.01)

(58) Field of Classification Search
CPC ..... A41D 3/005; A41D 27/10; A41D 31/02
See application file for complete search history.

(56) References Cited

U.S. PATENT DOCUMENTS

| | | | | |
|---|---|---|---|---|
| 3,837,006 | A | 9/1974 | Laseman | |
| 4,791,681 | A * | 12/1988 | Dean | A41D 13/012 2/102 |
| 8,566,963 | B2 * | 10/2013 | Ryan | A41D 27/201 2/252 |
| 9,295,292 | B2 * | 3/2016 | Sachs | A41D 27/205 |
| 9,414,631 | B2 * | 8/2016 | Schrimpf | A41D 27/20 |
| 9,554,601 | B2 * | 1/2017 | Arajakis | A41D 3/005 |
| 9,713,352 | B2 * | 7/2017 | Demarest | A41D 3/00 |
| 10,130,126 | B2 * | 11/2018 | Blauser | A41D 1/002 |
| 2008/0196140 | A1 * | 8/2008 | Mayerson | A41D 1/04 2/84 |
| 2009/0229034 | A1 * | 9/2009 | Zmigrosky | A41D 1/08 2/79 |

(Continued)

OTHER PUBLICATIONS

2018 Kangaroo Pocket Oversized Hoodie, https://www.zaful.com/kangaroo-pocket-oversized-hoodie-p_487027.html.

(Continued)

*Primary Examiner* — Richale L Quinn
(74) *Attorney, Agent, or Firm* — Thomas W. Galvani, P.C.; Thomas W. Galvani

(57) ABSTRACT

An overgarment includes a single body constructed from two soft, woven fabric plies and a torso in the body. Opposed sleeves are attached to the torso at sleeve openings, and the sleeves each have a top, an opposed bottom, and a length. A marsupial pocket on a front of the torso has a top and opposed bottom, the top of the marsupial pocket is above the bottom of each sleeve, and the bottom of the marsupial pocket is below the bottom of each sleeve.

16 Claims, 16 Drawing Sheets

(56) References Cited

U.S. PATENT DOCUMENTS

| | | | | |
|---|---|---|---|---|
| 2011/0185471 | A1* | 8/2011 | Buczkowski | A41D 27/20 2/84 |
| 2012/0005802 | A1* | 1/2012 | Claeys | A41D 27/20 2/84 |
| 2013/0219581 | A1* | 8/2013 | Schrimpf | A41D 27/20 2/69 |
| 2014/0310848 | A1* | 10/2014 | Ulriksen | A41D 27/285 2/69 |
| 2014/0317824 | A1 | 10/2014 | Browning et al. | |
| 2014/0331381 | A1* | 11/2014 | Arajakis | A41D 3/005 2/84 |
| 2016/0242474 | A1* | 8/2016 | Baschak | A41D 13/0015 |
| 2017/0020215 | A1* | 1/2017 | Merritt | A41D 27/201 |
| 2017/0079350 | A1* | 3/2017 | Hourani | A41D 27/201 |

OTHER PUBLICATIONS

Trefoil Oversize Hoodie, https://www.adidas.com/us/trefoil-oversize-hoodie/CW1248.html.

Stone Island Shadow Project Men zipped pocket sweatshirt, http://www.caribbeanmicrofinanceforum.com/stone-island-shadow-project-men-zipped-pocket-sweatshirt-boutique-high-quality-681960107-qacglom.html.

* cited by examiner

OVERGARMENT WITH AN ELEVATED MARSUPIAL POCKET

CROSS-REFERENCE TO RELATED APPLICATIONS

This application claims the benefit of U.S. Provisional Application No. 62/558,136, filed Sep. 13, 2017, and also of U.S. Provisional Application No. 62/671,417, filed May 14, 2018, both of which are hereby incorporated by reference.

FIELD OF THE INVENTION

The present invention relates generally to blankets, and more particularly to large, wearable blankets.

BACKGROUND OF THE INVENTION

Throw blankets are great at keeping a person warm and comfortable on the couch. Light blankets keep one comfortable on cool nights, and heavy blankets are wonderful for warming oneself on especially cold nights. But sadly, eventually, one must get up from the couch, whether to grab a hot chocolate, adjust the fire, or go to bed. When one gets up, they must leave the warm blanket behind and venture through their home a little colder.

Layering is often the answer when the question is how to stay warm inside a cool building. Layering is the process of wearing many layers of clothing on top of each other. One might wear a thin pair of polyester socks and a thick pair of wool socks, or an undershirt, a t-shirt, and a sweater, or even long underwear and jeans. But, layering is not always the most comfortable. Layering clothes can be constrictive in feeling and restrictive in movement. Children especially dislike layering, their response being to just "turn up the heat!"

However, turning up the heat is not always the answer. Sometimes, it feels good to be warmed by a blanket when the house is a little cold. But blankets simply are not practically portable when worn on the body. An improved, cozy, comfortable blanket is needed.

SUMMARY OF THE INVENTION

An overgarment includes a single body constructed from two soft, woven fabric plies and a torso in the body. Opposed sleeves are attached to the torso at sleeve openings, and the sleeves each have a top, an opposed bottom, and a length. A marsupial pocket on a front of the torso has a top and opposed bottom, the top of the marsupial pocket is above the bottom of each sleeve, and the bottom of the marsupial pocket is below the bottom of each sleeve.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
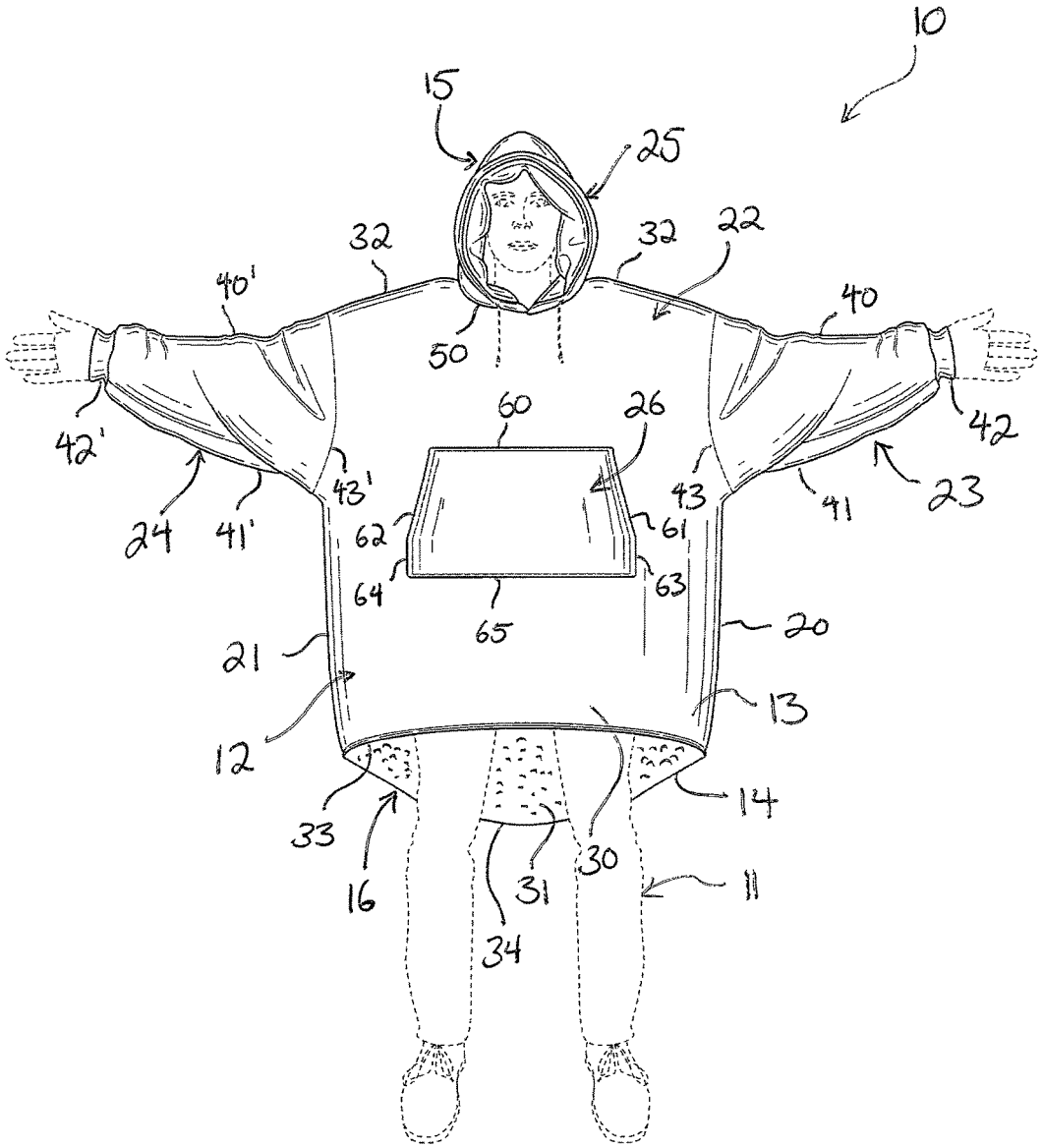
FIG. 1 is a front elevation view of an over-garment with an elevated marsupial pocket, as worn by a person shown in broken line in a standing position.

Reference now is made to the drawings, in which the same reference characters are used throughout the different figures to designate the same elements. FIG. 1 illustrates an enlarged over-garment with an elevated marsupial pocket (hereinafter, the "garment 10"), as worn by a person 11, shown in broken line, in a standing position. As can be seen clearly, the garment 10 is quite large, and its lengths, widths, proportions, and material construction are sufficiently different from conventional garments, thereby enabling the garment 10 to be used in different and unexpected ways. Indeed, the product shown in the drawings has experienced tremendous sales volume and copying by competitors since the year that the first provisional application disclosing the garment 10 was filed. The garment 10 uniquely provides a cozy, comfortable, warm, and spacious covering which can be worn in a reclining position, in a sitting position, in a fetal position, in a standing position, and even while walking.

The garment 10 includes a single body 12 generally having a front 13 and an opposed back 14, a top 15 and an opposed bottom 16, as well as left and right sides 20 and 21 extending from the top 15 to the bottom 16. The body 12 has a torso 22 to which opposed left and right sleeves 23 and 24 are attached at the left and right sides 20 and 21, respectively. A hood 25 is attached to the torso 22 at the top 15, and a marsupial pocket 26 is attached to the front 13 of the garment 10. For perspective, the person 11 is approximately six feet in height and one hundred sixty pounds in weight.

The body 12 of the garment 10 is preferably constructed from two plies of a soft, woven, flexible fabric material, defining an inner ply and an outer ply. An outer ply 30 is on the outside of the body 12. The outer ply 30 is constructed from a soft yet tough and slightly elastic material with a low-pile knit, such as fleece or microfiber. The finish on the outer ply 30 is smooth. An inner ply 31 of the material is also constructed from a soft yet tough material, but has a rougher, high-pile knit, which produces a large and fuzzy fur-like finish.

The torso 22 is formed by the outer and inner plies 30 and 31 sewn together at various points or along seams. The torso 22 generally extends between shoulder seams 32 proximate the top 15 of the garment 10 and a bottom hem or edge 33 of both the front 13 and back 14 of the garment 10. The outer and inner plies 30 and 31 form a front panel at the front 13 of the torso 22 and a back panel at the back 14 of the torso 22. The front panel is a single and continuous sheet extending from the shoulder seams 32 to the bottom edge 33 and between the left and right sides 20 and 21, at the front 13 of the body 12. Similarly, the back panel is a single and continuous sheet extending from the shoulder seams 32 to the bottom edge 33 and between the left and right sides 20 and 21, at the back 14 of the body 12. The front and back panels are sewn to each other to form the body 12 and are held loosely near each other but not necessarily bonded, fastened, or attached to either continuously or intermittently between the left and right sides 20 and 21 or between the top 15 and bottom 16. The outer and inner plies 30 and 31 are sewn to each other along the shoulder seams 32, which extend from the hood 25 to each of the left and right sleeves 23 and 24. They are sewn to each other along two side seams, which extend vertically down the left and side sides 20 and 21 between the left and right sleeves 23 and 24 to the bottom edge 33. Although the word "sewn" is used to describe the manner of fastening the front and back panels herein, it should be understood that the outer and inner plies 30 and 31 are not necessarily attached by stitching or sewing; they may be fixed or attached to each by fabric welding, adhesive, buttons, slide fasteners, or other similar fastening means and methods. Indeed, all structures of the garment 10 which are attached to each other may be fastened in one of these ways, unless this description specifically states otherwise.

Figure 9:
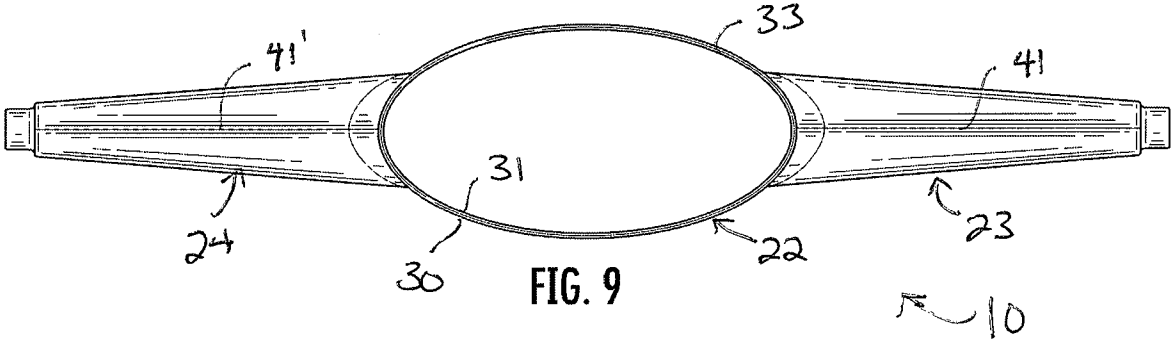

The bottom edge 33 is open. The bottom edge 33 is a roughly annular or oval-shaped hem piece (as shown in FIG. 9) attached to the torso 22 with stitching through the outer and inner plies 30 and 31 so that the front and back panels do not fray or develop loose ends. The bottom edge 33 is constructed from a soft and flexible—yet inelastic—fabric material, so that while the material of the torso 22 may elastically stretch, the bottom edge 33 does not.

Figure 8:
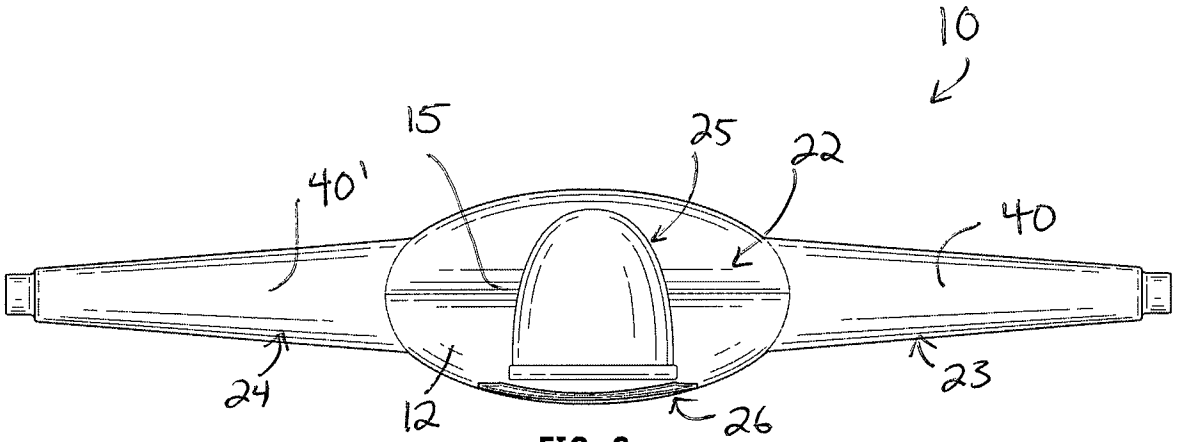
FIGS. 8 and 9 are top and bottom plan views, respectively, of the over-garment with an elevated marsupial pocket shown in FIG. 1.

Shown in FIGS. 1 and 8, opposite the bottom edge 33 is the hood 25 attached to the top 15 of the garment 10. The hood 25 is formed from two generally rectangular sheets of material which are also constructed from the outer and inner plies 30 and 31. The two sheets are sewn together along two edges to form the hood 25, which is then sewn onto a neck opening 50 in the body 12. The neck opening 50 is circular, having a semi-circular seam extending across the front 13 between the shoulder seams 32 and a semi-circular seam extending across the back 14 between the shoulder seams 32. Thus, nearly defining a circular hole, the neck opening 50 has a neck diameter D between the opposed shoulder seams 32 of approximately five inches. The forward free edges of the hood 25 are hemmed. In some embodiments, a drawstring cord is inserted and threaded through the hem so that the person 11 may adjust the size of the opening of the hood 25. The cord is shown in broken line in FIG. 1, but in most embodiments, the hood 25 does not have a drawstring.

With the combination of the shoulder seams 32, the sewn left and right sides 20 and 21 from the left and right sleeves 23 and 24 down, and the inelastic bottom edge 33, the torso 22 is defined roughly as an inverted "pocket" with a lower opening at the bottom edge 33. This inverted pocket is quite large, and is capable of receiving and covering an entire person when that person is sitting in a fetal position. For smaller children, such as under ten years old, the large torso 22 will completely cover them even when standing. The torso 22 has a width T between the left and right sides 20 and 21 at the bottoms 41 and 41' of the opposed left and right sleeves 23 and 24 which is approximately thirty-seven inches. The width T is approximately 7.4 times the neck diameter D of the neck opening 50. The torso 22 has a height A between the neck opening 50 and the bottom edge 33 of the torso 22, wherein the height A is approximately thirty-three inches. The torso also measures approximately forty-one inches between the neck opening 50 and the bottom edge 33 of the back 14 of the torso 22.

To ensure that the torso 22 covers a person when sitting in the fetal position, the bottom edge 33 extends further downward at the back 14 of the garment 10 than it does on the front 13. In other words, the back 14 of the garment 10 is longer than the front 13. As shown in FIGS. 1-7, the bottom edge 33 at the back 14 of the garment has a tail 34. The tail 34 is located centrally between the opposed left and right sides 20 and 21 and is an arcuate projection downward. It is a convex extension of the back 14; the bottom edge 33 slopes in a convex fashion between the left and right sides 20 and 21 to form the tail on the back 14. In contrast, the bottom edge 33 is nearly straight across between the left and right sides 20 and 21 at the front 13 of the garment 10.

Figure 2:
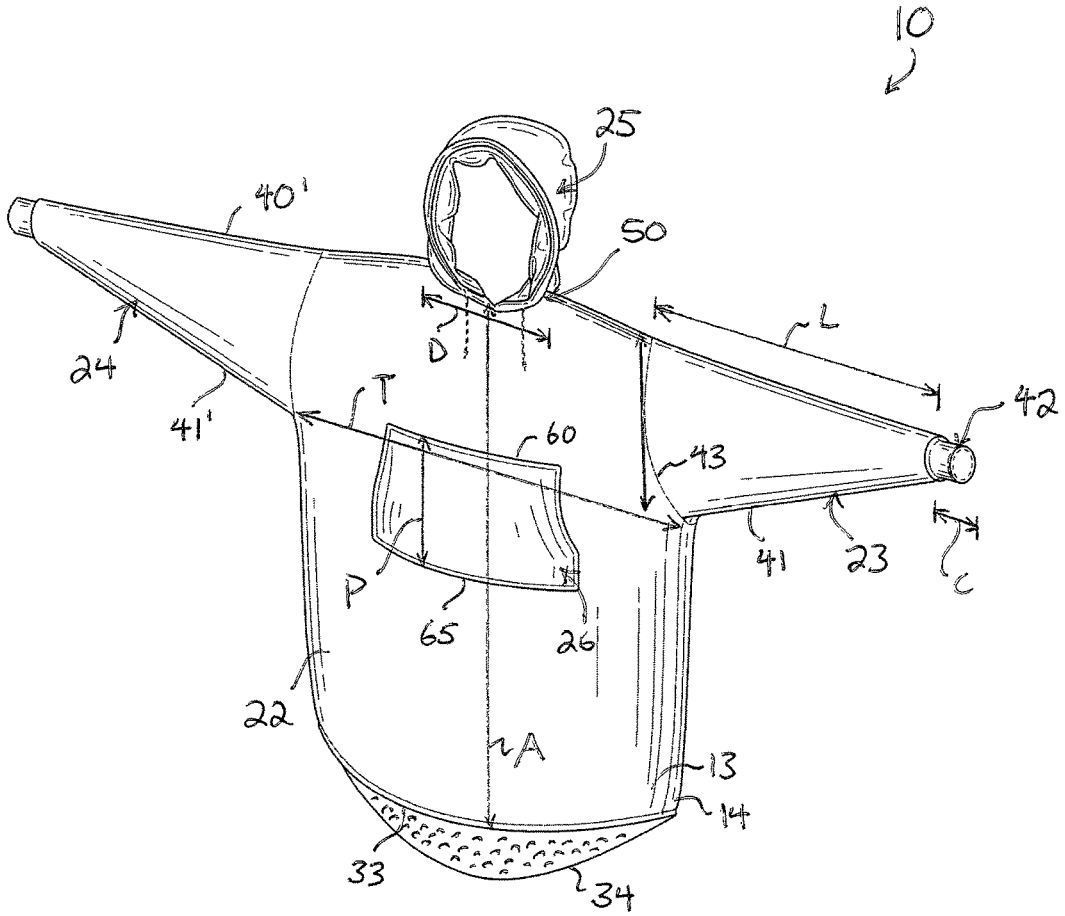
FIGS. 2 and 3 are top and bottom perspective views, respectively, of the over-garment with an elevated marsupial pocket shown in FIG. 1.
Figure 3:
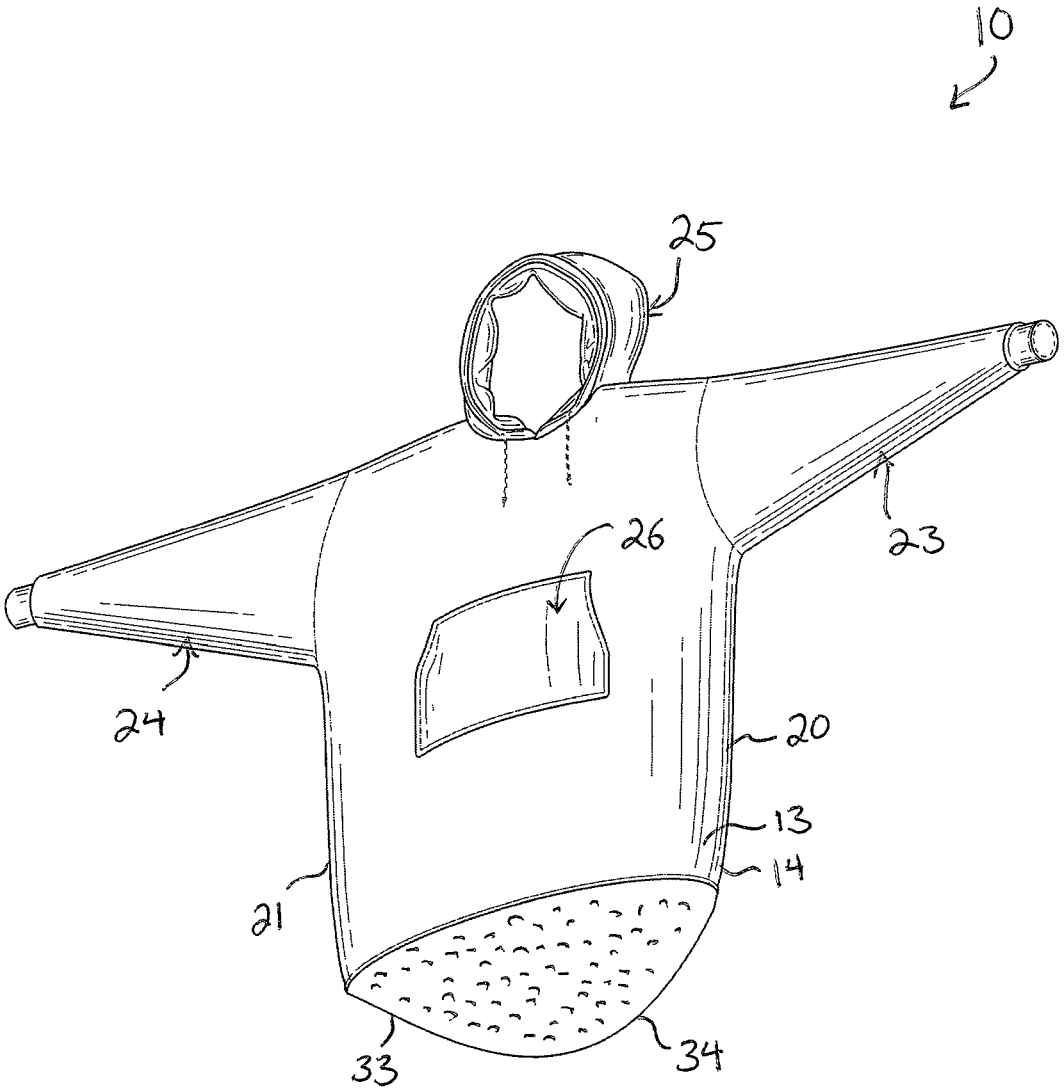
Figure 4:
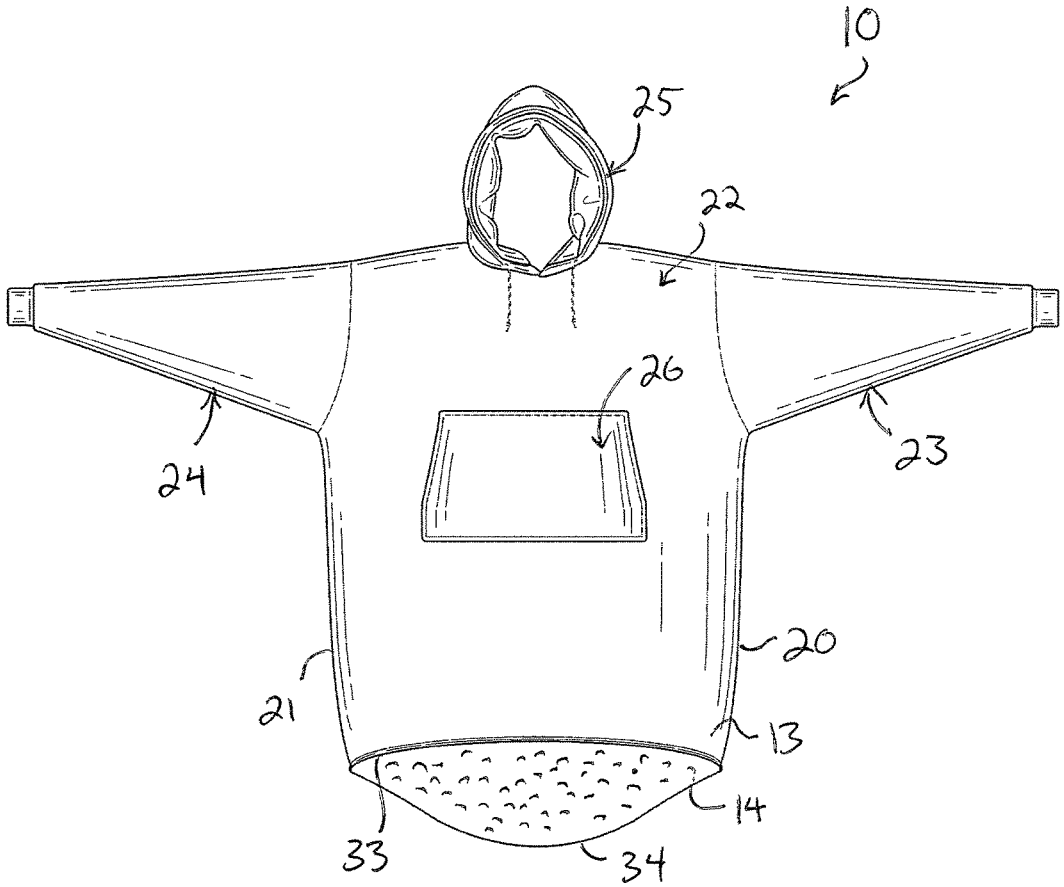
FIGS. 4 and 5 are front and rear elevation views, respectively, of the over-garment with an elevated marsupial pocket shown in FIG. 1.
Figure 5:
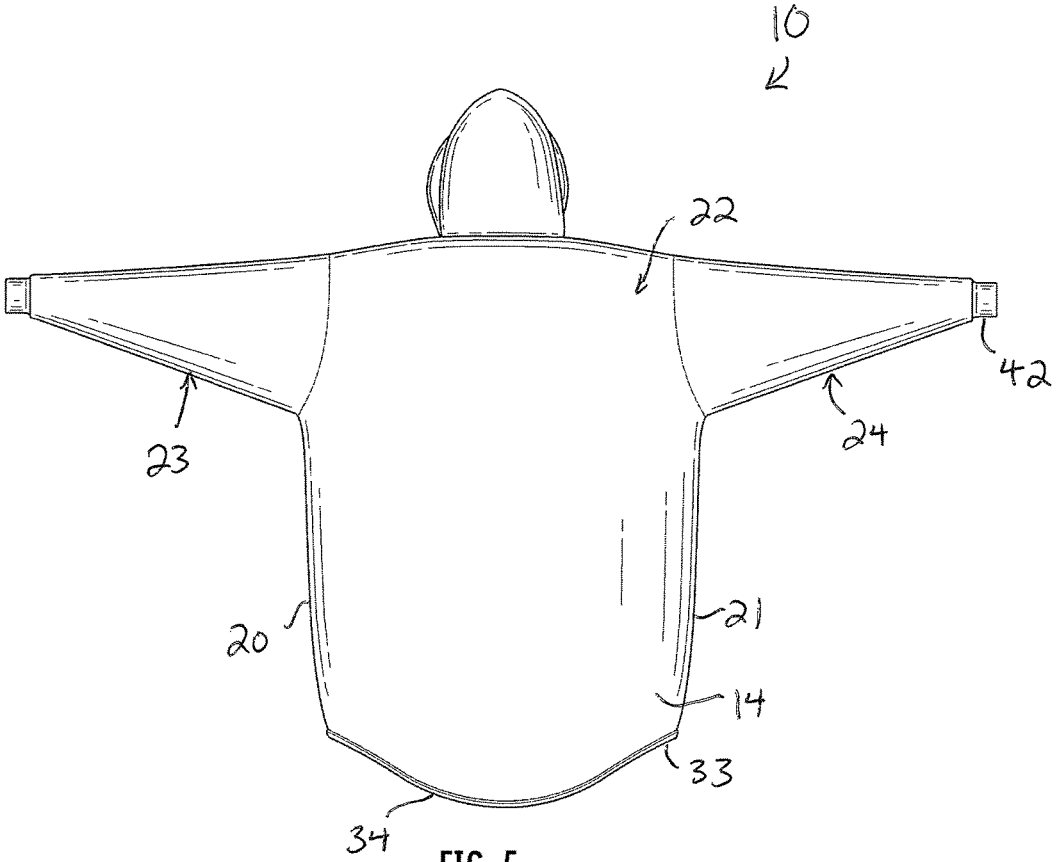
Figure 6:
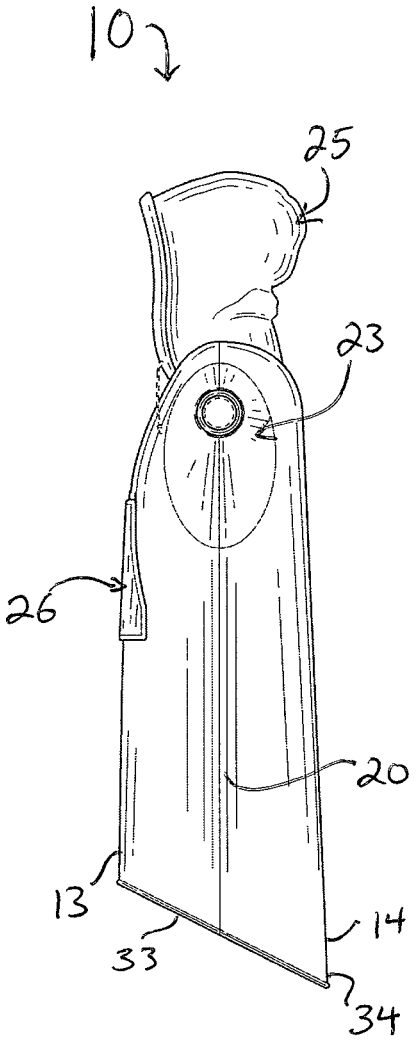
FIGS. 6 and 7 are left and right side elevation views, respectively, of the over-garment with an elevated marsupial pocket shown in FIG. 1.
Figure 7:
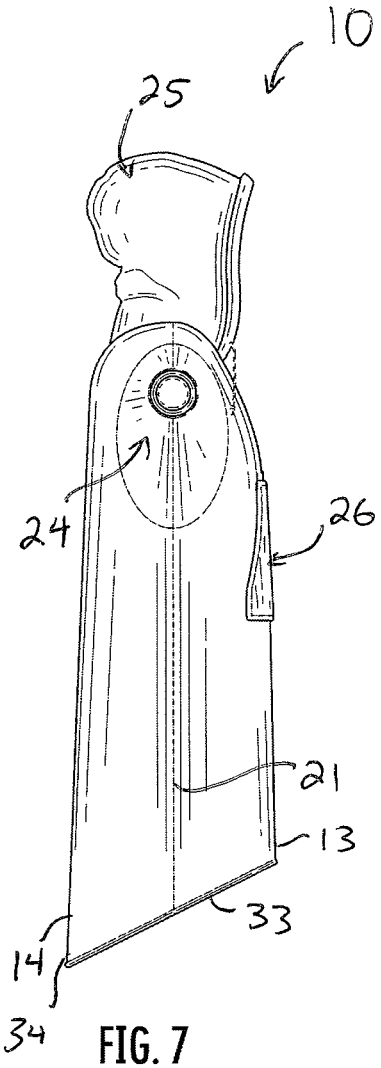
Figure 10:
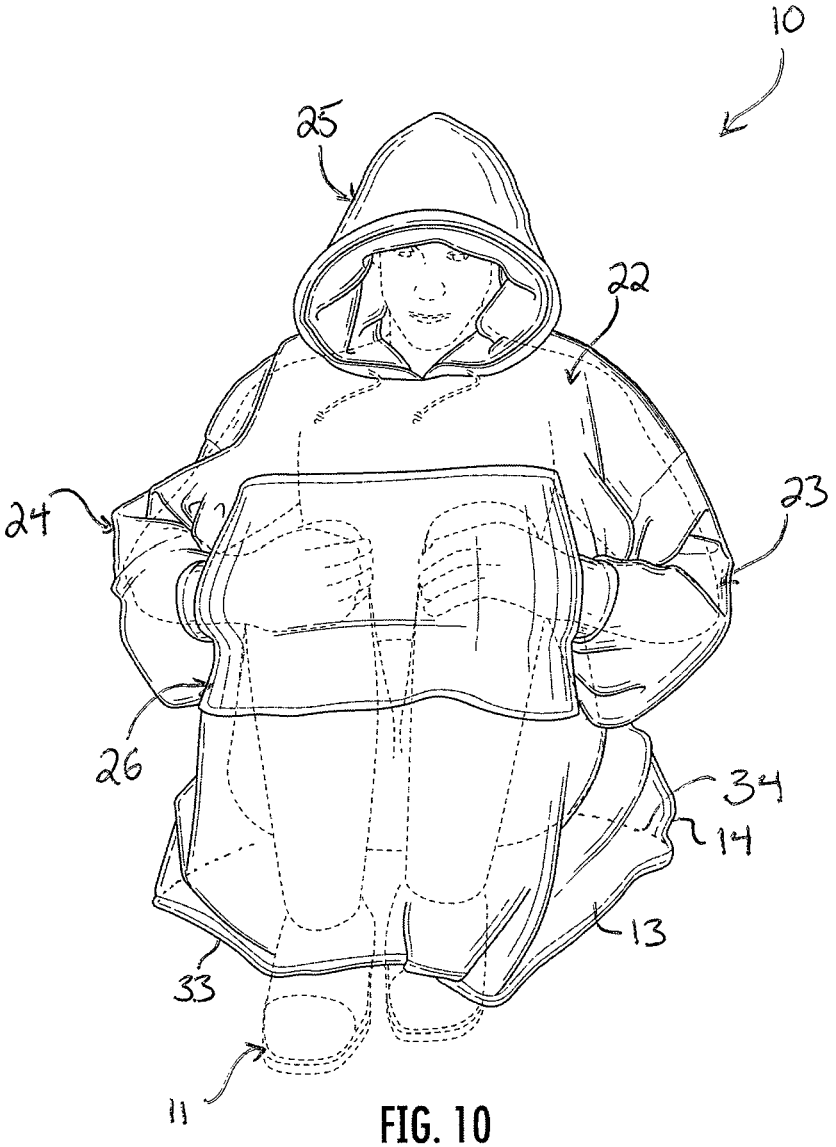
FIG. 10 is a front perspective view of the over-garment with an elevated marsupial pocket shown in FIG. 1 as worn by a person, partially hidden, shown in broken line in a sitting fetal position.

This unique construction allows the garment 10 to be pulled over a person's knees when the person 11 is in a sitting or fetal position, as in FIG. 10, without exposing the person's front or back. The left and right sleeves 23 and 24 further allow a person to cocoon or maximize their comfort within the garment. Referring to FIG. 1, the left and right sleeves 23 and 24 are opposite and identical. As such, description herein will be limited to the left sleeve 23, with the understanding that the description applies equally to the right sleeve 24. Nevertheless, throughout this description and the drawings, the same reference characters are used for identical structural elements and features of the left and right sleeves 23 and 24, but those of the right sleeve 24 are marked with a prime ("") symbol to distinguish them from those of the left sleeve 23. The left sleeve 23 is fashioned from a single sheet of two-ply material, which, like the body 12, is also constructed from the outer and inner plies 30 and 31. The left sleeve 23 has a top 40 and an opposed underside bottom 41. A sewn seam extends along the bottom 41 of the left sleeve 23, forming the sheet into the conical sleeve shape seen in the drawings. The left sleeve 23 has a length L (shown in FIG. 2) which terminates distally from the torso 22 at a highly-elastic cuff 42. In FIG. 1, the left sleeve 23 is bunched up, such that the full length L is not shown relative to the length of the arm of the person 11. However, FIG. 2 shows the extended (but not stretched) length L. This length L is greater than the arm length of the person 11. Indeed, the length L is quite large; it is approximately twenty-five inches, and is approximately five times the neck diameter D. The cuff 42 constricts to tightly conform to the wrist of the person 11. The cuff 42 has a length C which is approximately two inches. The length C of the cuff 42 is approximately 0.6 times the neck diameter D.

The left sleeve 23 is sewn to the body 12 at a sleeve hole or opening 43 which is extremely large. The sleeve opening 43 is disproportionately large with respect to the person 11, which causes the left sleeve 23 to be disproportionately large as well. The sleeve opening 43 has a height H (shown in FIG. 2) between the top 40 and bottom 41 of the left sleeve 23 which is approximately fifteen inches. The neck diameter D of the neck opening 50 is approximately one-third of the height H of the sleeve opening 43. This allows the person 11 to move his or her arm into and out of the left sleeve 23 easily and to bend, fold, or hide his or her arm within the left sleeve 23 without getting caught by or even stretching the left sleeve 23. This also allows the person 11 to extend his or her arms through the left sleeve 23, pull them in through the left sleeve 23, or even fold them inside the left sleeve 23 comfortably. The sleeve opening 43 extends vertically from its top 40 at the shoulder seam 32 to its bottom 41. The bottom 41 of the sleeve opening 43 is approximately level with a middle of the marsupial pocket 26, as is explained more below.

The marsupial pocket 26 is carried on the outer ply 30 of the garment 10, at the front 13 thereof. The pocket 26 has a top 60, opposed diagonal sides 61 and 62, opposed short sides 63 and 64, and a bottom 65. The top 60, short sides 63 and 64, and the bottom 65 are sewn to the outer ply 30 of the garment 10, leaving the diagonal sides 61 and 62 free and open. This allows the marsupial pocket 26 to carry items therein or to receive the hands for warmth.

The marsupial pocket 26 is disposed in a relatively high position on the garment 10 relative to the top 15 and bottom 16. As seen in FIG. 1, the top 60 of the marsupial pocket 26 is well above halfway between the neck opening 50 and the bottom edge 33 at the bottom 16 of the garment 10. And the bottom 65 of the marsupial pocket 26 is spaced approximately one-quarter the height of the garment 10 from the bottom 16. Further, the top 60 of the marsupial pocket 26 is above the bottom 41 of each of the left and right sleeves 23 and 24, and the bottom 65 of the marsupial pocket 26 is below the bottom 41 of each of the left and right sleeves 23 and 24. This is a raised position of the marsupial pocket 26 with respect to conventional "hoodie"-style sweatshirts and provides unique features as described later. The top 60 of the marsupial pocket 26 is approximately nine inches from the bottom of the neck opening 50, and the bottom 65 of the marsupial pocket 26 is approximately thirteen inches from the bottom edge 33 of the front 13 of the garment 10, and the marsupial pocket 26 has a height P which is approximately eleven inches. This height P is approximately 1.2 times the distance between the neck opening 50 and the top 60 of the marsupial pocket 26. Further, the height A between the neck opening 50 and the bottom edge 33 is approximately three times the height P of the marsupial pocket 26, and a distance between the neck opening 50 and the bottom edge 33 of the back 14 of the torso 22 is approximately 3.7 times the height P of the marsupial pocket 26.

As should now be clear, the garment 10 is quite large, and as shown in FIGS. 1 and 10 is useful both as an over-garment similar to a jacket and as a blanket, under which the body can be curled up for warmth and coziness. The disproportionate sizes of the various parts of the garment 10 allow it to be worn, placed, or draped over one's whole body for full-body comfort and coziness. The garment 10 is worn on the body of the person 11 like an article of clothing: the torso 22 is placed over the person's torso, their left arm is extended through the left sleeve 23, their right arm is extended through the right sleeve 24, and the hood 25 is placed over the person's head.

Even though the garment 10 is worn like a typical article of clothing, it is much different. The body 12 is considerably wider than a conventional article of clothing, being approximately three to four times wider and approximately one-and-a-half times longer. The sleeve openings 43 and 43' are at least twice as large as those on a typical article of clothing. This, in part, allows the person 11 to drape the garment 10 like a blanket when worn, and to even cover the person 11 when in a fetal position, as shown in FIG. 10, or to bring his or her arms into and out of the left and right sleeves 23 and 24 easily and without stretching the left and right sleeves 23 and 24.

The person 11 can also bunch up the left and right sleeves 23 and 24 and place his or her hands into the marsupial pocket 26 for warmth without stretching his or her arms far down, since the marsupial pocket 26 is disposed at an elevated position with respect to the bottom edge 33 of the garment 10. And, when the person 11 is crouched in the fetal position as in FIG. 10, the marsupial pocket 26 is disposed in front of the person's knees, rather than at his or her shins or feet, so that the person 11 can easily reach around the knees and place his or her hands within the marsupial pocket 26, even holding the knees at the same time. In other words, when the garment 10 is worn and the person 11 is in a fetal position, the marsupial pocket 26 is disposed in front of the knees of the person 11. Further, the tail 34 of the garment 10, because it is elongated and extends further down than the bottom edge 33 does at the front 13, does not expose the buttocks or back of the person 11, but rather covers the rear of the person 11 fully. As such, when the person 11 is in the fetal position, the bottom edge 33 extends fully to cover the person 11 entirely around. It is the particular sizes, arrangements, and proportions of the garment 10 and its constituent structural elements and features, as described above, which create these features and advantages that are not available in the prior art. Indeed, because of the differences in structural elements and features described in the many paragraphs above, the product disclosed here has experienced tremendous first-year global sales and has been copied across the world. Consumers and the competition have adopted this garment 10 as one which is different, which is different in unique ways, and which offers unique features not available in other garments or blankets.

Figure 11:
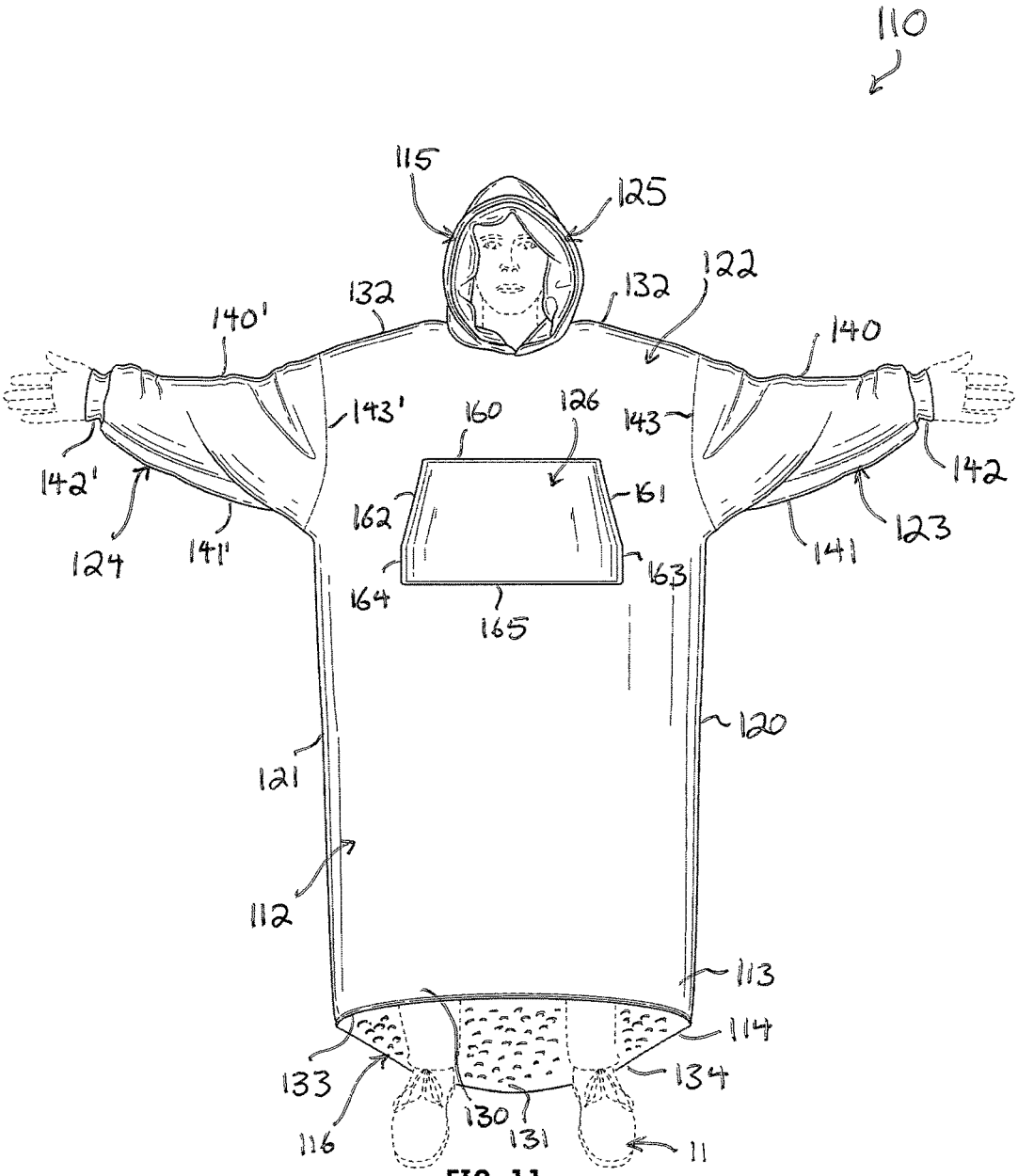
FIG. 11 is a front elevation view of another embodiment of an over-garment with an elevated marsupial pocket, as worn by a person shown in broken line in a standing position.

FIG. 11 illustrates another embodiment of an enlarged over-garment with an elevated marsupial pocket (hereinafter, the "garment 110"), as worn by a person 111, shown in broken line, in a standing position. This garment 110 is also quite large, and its lengths, widths, proportions, and material construction are sufficiently different from conventional garments, enabling the garment 110 to be used in different and unexpected ways, as described below. The garment 110 uniquely provides a cozy, comfortable, warm, and spacious covering which can be worn in a reclining position, in a sitting position, in a fetal position, in a standing position, and even while walking.

The garment 110 includes a single body 112 generally having a front 113 and an opposed back 114, a top 115 and an opposed bottom 116, as well as left and right sides 120 and 121 extending from the top 115 to the bottom 116. The body 112 has a torso 122 to which opposed left and right sleeves 123 and 124 are attached at the left and right sides 120 and 121, respectively. A hood 125 is attached to the torso 122 at the top 115, and a marsupial pocket 126 is attached to the front 113 of the garment 110. For perspective, the person 111 is approximately six feet in height and one hundred sixty pounds in weight.

The body 112 of the garment 110 is preferably constructed from two plies of a soft, woven, flexible fabric material, defining an inner and an outer layer. An outer ply 130 is on the outside of the body 112. The outer ply 130 is constructed from a soft yet tough and slightly elastic material with a low-pile knit, such as fleece or microfiber. The finish on the outer ply 130 is smooth. An inner ply 131 of the material is also constructed from a soft yet tough material, but has a rougher, high-pile knit, which produces a large and fuzzy fur-like finish.

The torso 122 is formed by the outer and inner plies 130 and 131 sewn together at various points or along seams. The torso 122 generally extends between shoulder seams 132 proximate the top 115 of the garment 110 and a bottom hem or edge 133 of both the front 113 and back 114 of the garment 110. The outer and inner plies 130 and 131 form a front panel at the front 113 of the torso 122 and a back panel at the back 114 of the torso 122. The front panel is a single and continuous sheet extending from the shoulder seams 132 to the bottom edge 133 and between the left and right sides 120 and 121, at the front 113 of the body 112. Similarly, the back panel is a single and continuous sheet extending from the shoulder seams 132 to the bottom edge 133 and between the left and right sides 120 and 121, at the back 114 of the body 112. The front and back panels are sewn to each other to form the body 112 and are held loosely near each other but not necessarily bonded, fastened, or attached to either continuously or intermittently between the left and right sides 120 and 121 or between the top 115 and bottom 116. The outer and inner plies 130 and 131 are sewn to each other along the shoulder seams 132, which extend from the hood 125 to each of the left and right sleeves 123 and 124. They are sewn to each other along two side seams, which extend vertically down the left and side sides 120 and 121 between the left and right sleeves 123 and 124 to the bottom edge 133. Although the word "sewn" is used to describe the manner of fastening the front and back panels herein, it should be understood that the outer and inner plies 130 and 131 are not necessarily attached by stitching; they may be fixed or attached to each by fabric welding, adhesive, buttons, slide fasteners, or other similar fastening means and methods. Indeed, all structures of the garment 10 which are attached to each other may be fastened in one of these ways, unless this description specifically states otherwise.

Figure 19:
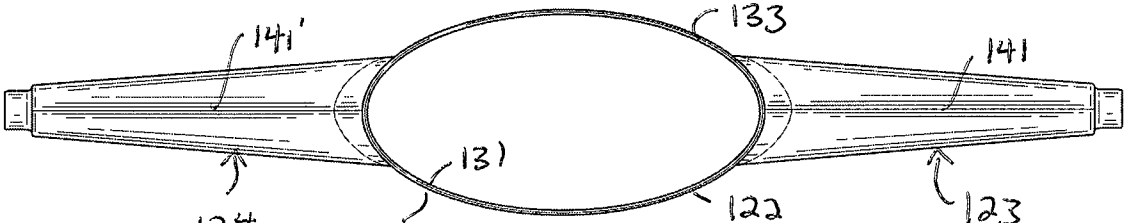

The bottom edge 133 is open. The bottom edge 133 is a roughly annular or oval-shaped hem piece (as shown in FIG. 19) attached to the torso 122 with stitching through the outer and inner plies 130 and 131 so that the front and back panels do not fray or develop loose ends. The bottom edge 133 is constructed from a soft and flexible—yet inelastic—fabric material, so that while the material of the torso 122 may elastically stretch, the bottom edge 133 does not.

Opposite the bottom edge 133 is the hood 125 attached to the top 115 of the garment 110. The hood 125 is formed from two generally rectangular sheets of material which are also constructed from the outer and inner plies 130 and 131. The two sheets are sewn together along two edges to form the hood 125, which is then sewn onto a neck opening 150 in the body 112. The neck opening 150 is circular, having a semi-circular seam extending across the front 113 between the shoulder seams 132 and a semi-circular seam extending across the back 114 between the shoulder seams 132. Thus, nearly defining a circular hole, the neck opening 150 has a neck diameter D between the opposed shoulder seams 132 which is approximately five inches. The forward free edges of the hood 125 are hemmed. In some embodiments, a drawstring cord is inserted and threaded through the hem so that the person 111 may adjust the size of the opening of the hood 125, but in most embodiments, the hood 125 does not have a drawstring.

With the combination of the shoulder seams 132, the sewn left and right sides 120 and 121 from the left and right sleeves 123 and 124 down, and the inelastic bottom edge 133, the torso 122 is defined roughly as an inverted "pocket" with a lower opening at the bottom edge 133. This inverted pocket is quite large, and is capable of receiving and covering an entire person when that person is sitting in a fetal position, and is nearly capable of receiving and entirely covering a six-foot man in a standing position. For smaller children, such as under ten years old, the large torso 122 will easily completely cover them even when standing. The torso 122 has a width T between the bottoms 141 and 141' of the opposed left and right sleeves 123 and 124 which is approximately thirty-seven inches. The width T is approximately 7.4 times the neck diameter D of the neck opening 150. The torso 122 has a height B between the neck opening 150 and the bottom edge 133 of the torso 122, wherein the height B is fifty-one inches. The torso also measures approximately fifty-nine inches between the neck opening 150 and the bottom edge 133 of the back 114 of the torso 122.

To ensure that the torso 122 covers a person when sitting in the fetal position, the bottom edge 133 extends further downward at the back 114 of the garment 110 than it does on the front 113. In other words, the back 114 of the garment 110 is longer than the front 113. As shown in FIGS. 11-17, the bottom edge 133 at the back 114 of the garment has a tail 134. The tail 134 is located centrally between the opposed left and right sides 120 and 121 and is an arcuate projection downward. The bottom edge 133 slopes in a convex fashion between the left and right sides 120 and 121 to form the tail on the back 114. In contrast, the bottom edge 133 is nearly straight across between the left and right sides 120 and 121 at the front 113 of the garment 110.

Figure 12:
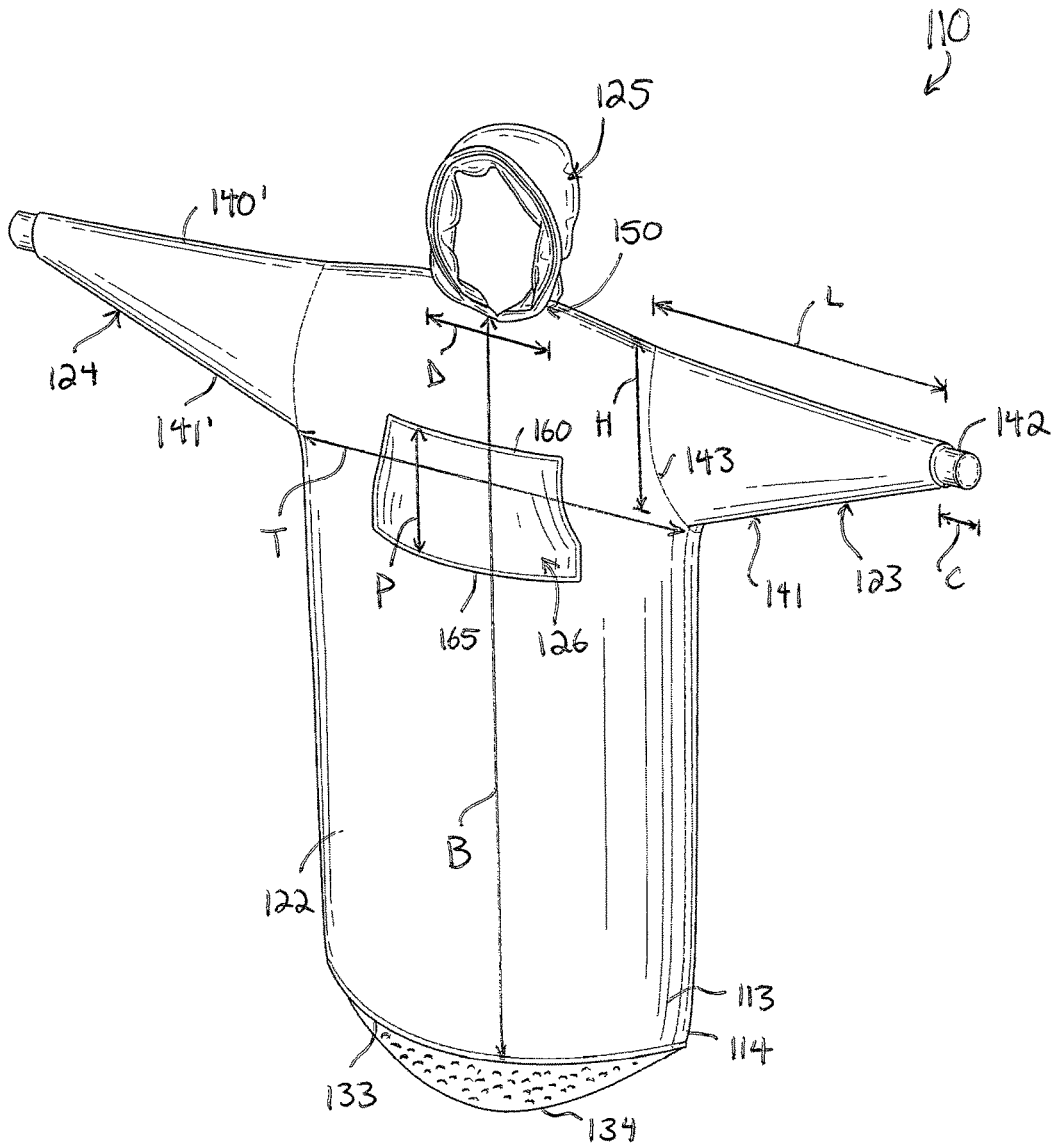
FIGS. 12 and 13 are front and rear perspective views, respectively, of the over-garment with an elevated marsupial pocket shown in FIG. 11.
Figure 13:
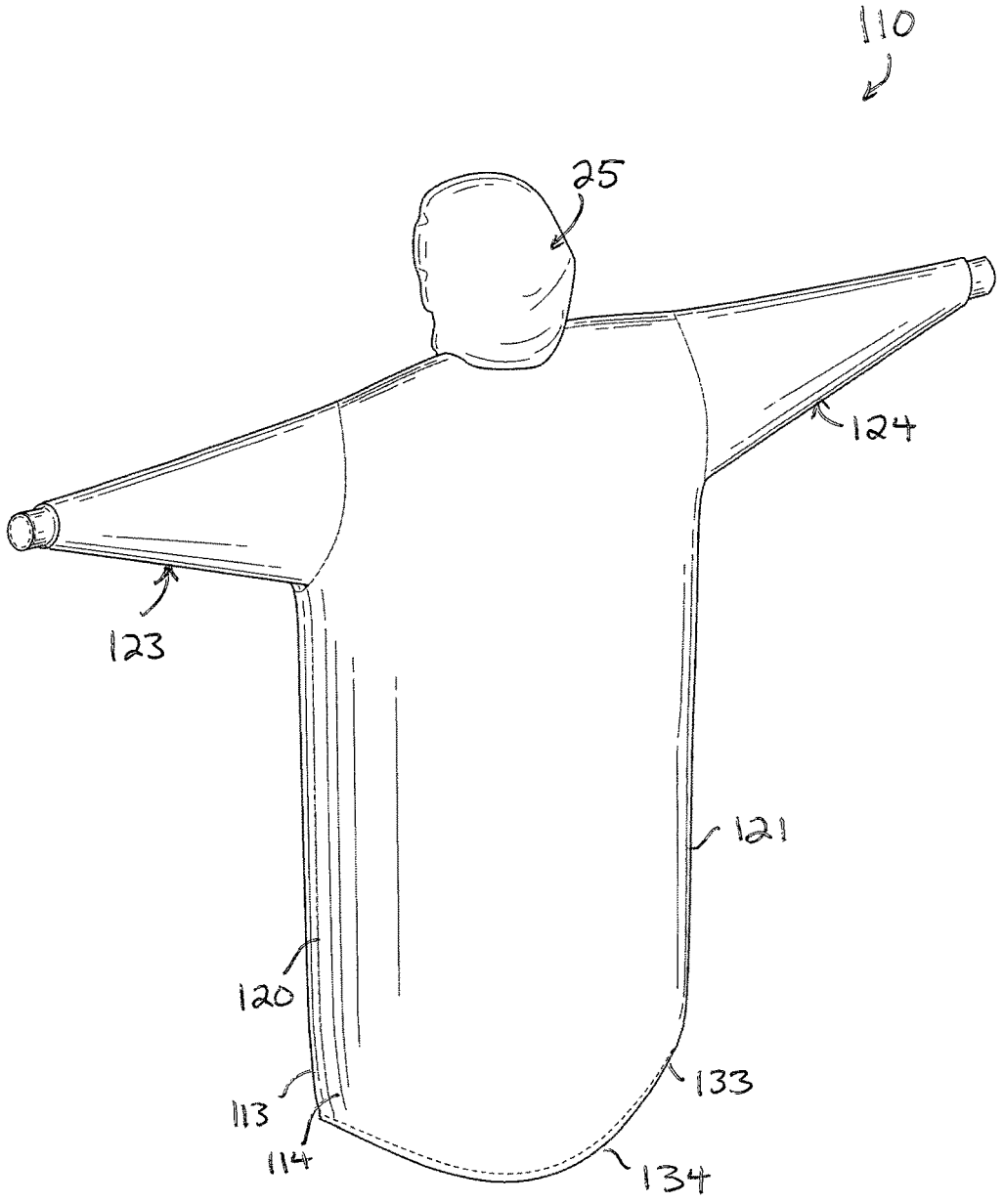
Figure 14:
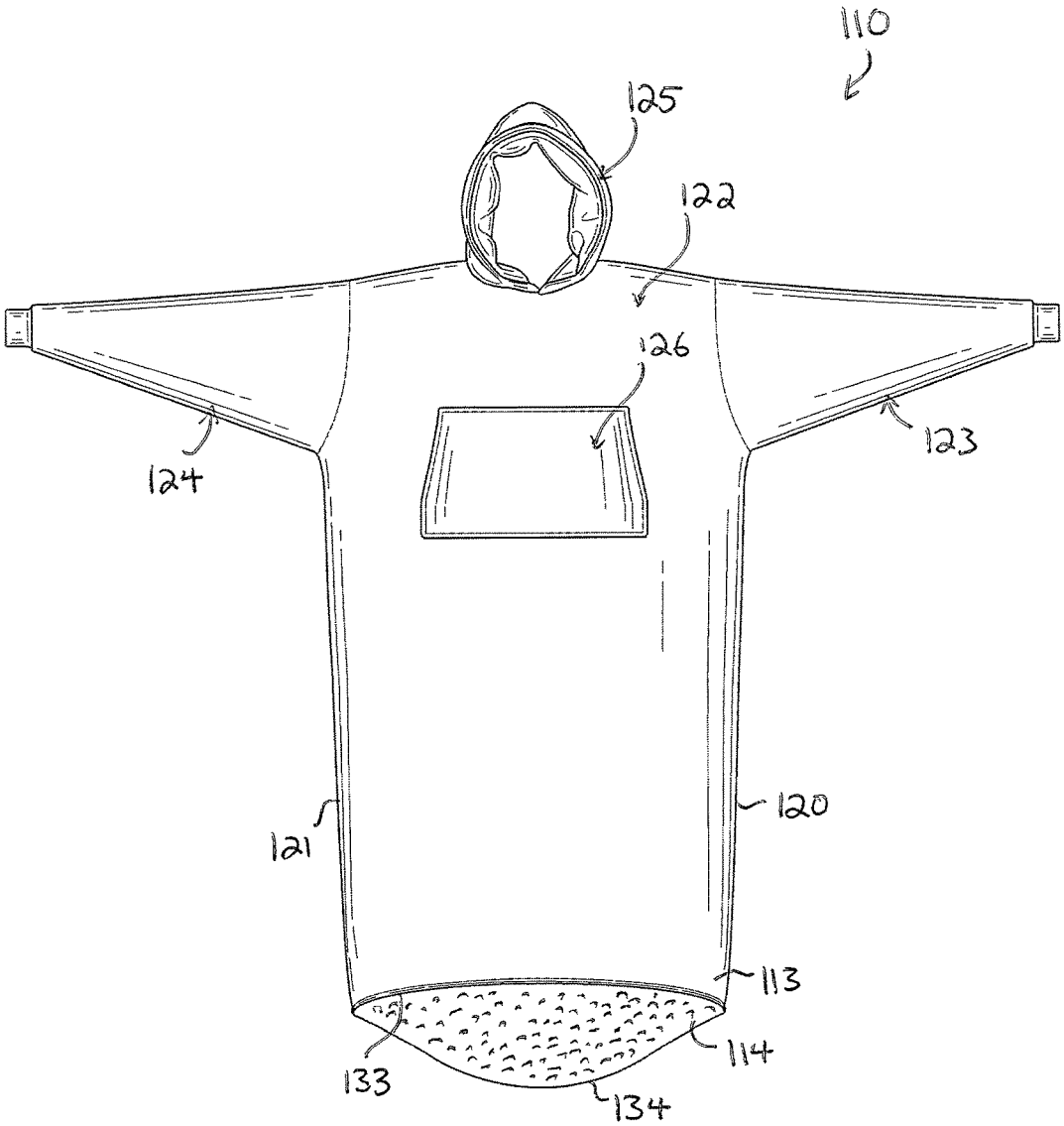
FIGS. 14 and 15 are front and rear elevation views of the over-garment with an elevated marsupial pocket shown in FIG. 11.
Figure 15:
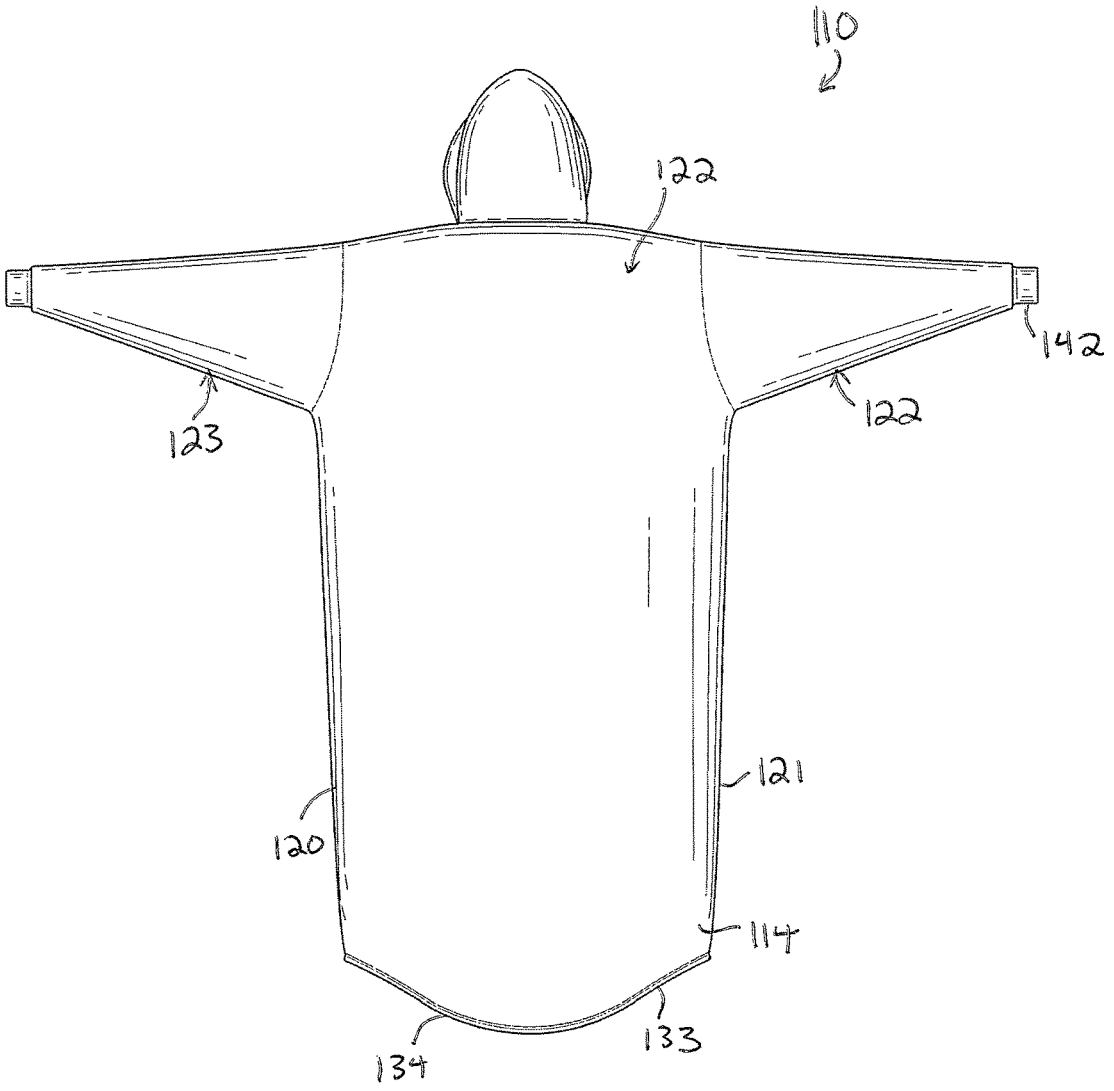
Figure 16:
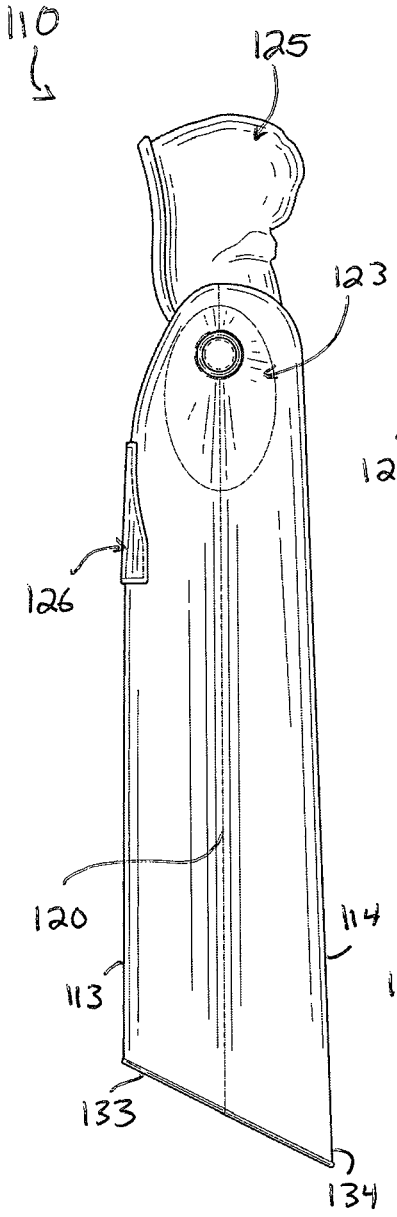
FIGS. 16 and 17 are left and right side elevation views of the over-garment with an elevated marsupial pocket shown in FIG. 11.
Figure 17:
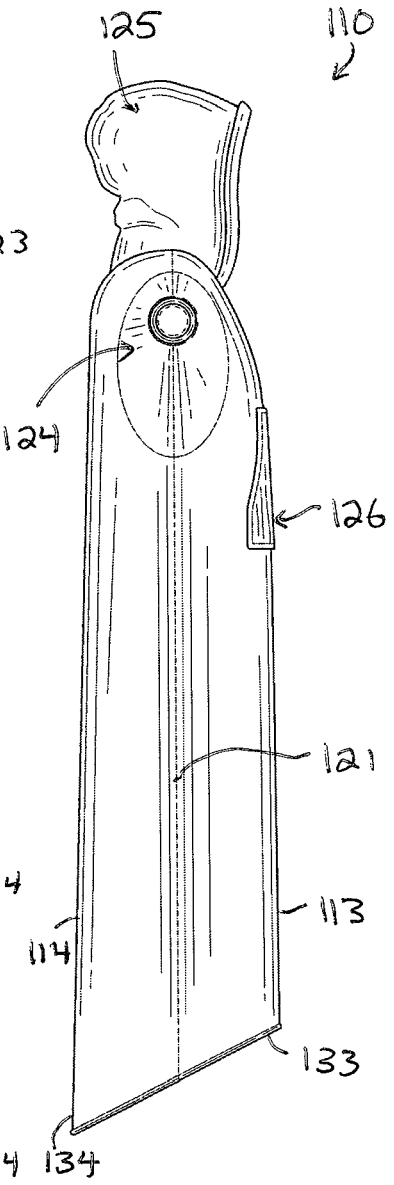
Figure 18:
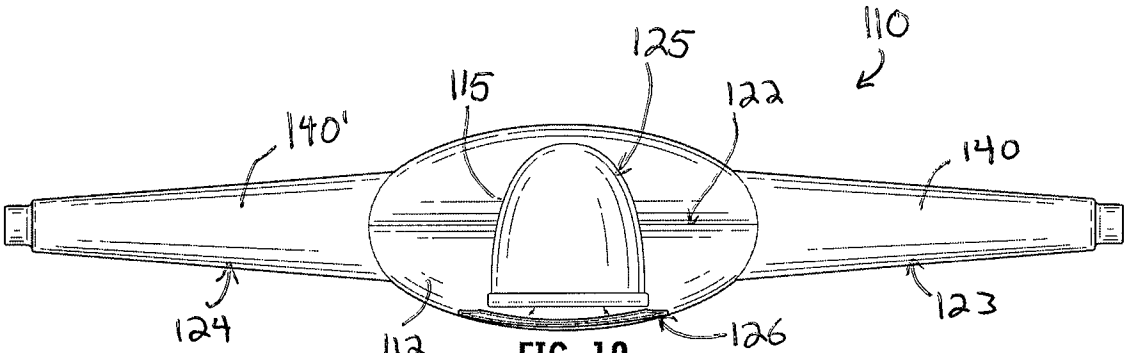
FIGS. 18 and 19 are top and bottom plan views, respectively, of the over-garment with an elevated marsupial pocket shown in FIG. 11.
Figure 20:
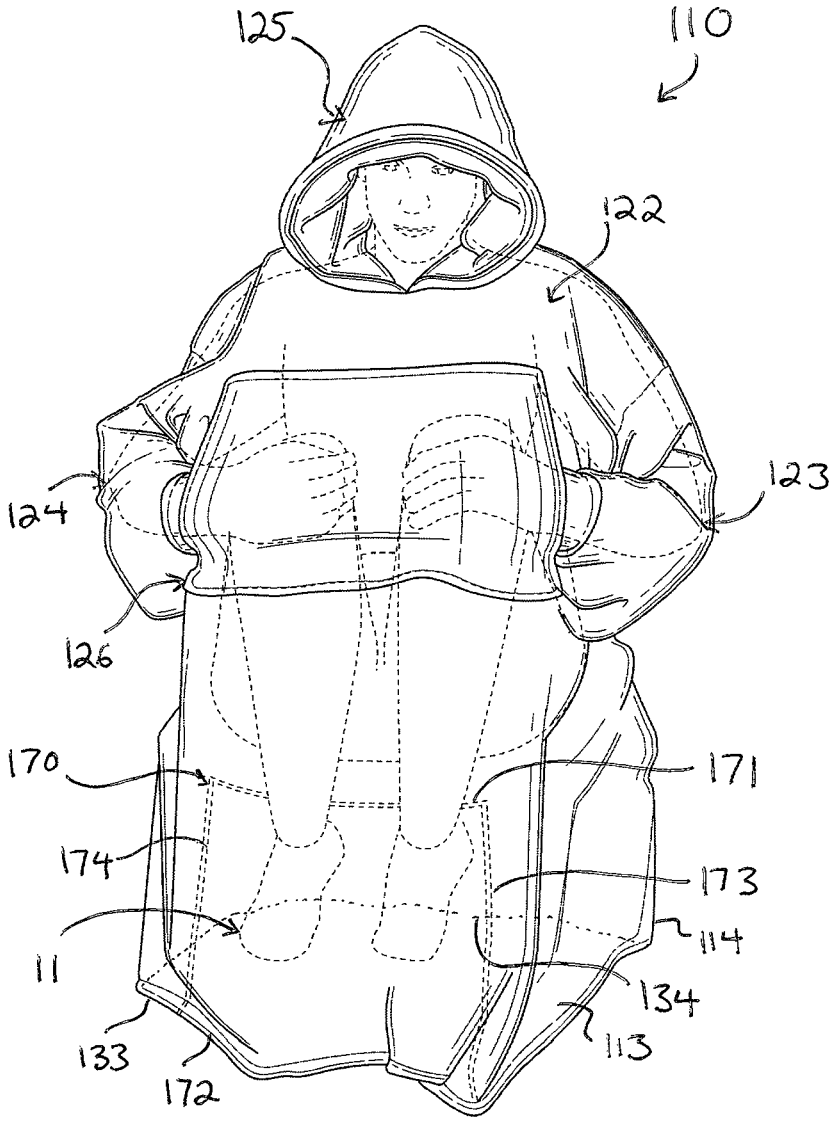
FIG. 20 is a front perspective view of the over-garment with an elevated marsupial pocket shown in FIG. 11 as worn by a person, partially hidden, shown in broken line in a sitting fetal position.

This unique construction allows the garment 110 to be pulled over a person's knees when the person 111 is in a sitting or fetal position, as in FIG. 20, without exposing the person's front or back. The left and right sleeves 123 and 124 further allow a person to cocoon or maximize their comfort within the garment. The left and right sleeves 123 and 124 are opposite and identical. As such, description herein will be limited to the left sleeve 123, with the understanding that the description applies equally to the right sleeve 124. Nevertheless, throughout this description and the drawings, the same reference characters are used for identical structural elements and features of the left and right sleeves 123 and 124, but those of the right sleeve 124 are marked with a prime ("") symbol to distinguish them from those of the left sleeve 123. Referring to FIG. 11, the left sleeve 123 is fashioned from a single sheet of two-ply material, which, like the body 112, is also constructed from the outer and inner plies 130 and 131. The left sleeve 123 has a top 140 and an opposed underside bottom 141. A sewn seam extends along the bottom 141 of the left sleeve 123, forming the sheet into the conical sleeve shape seen in the drawings. The left sleeve 123 has a length L (shown in FIG. 12) which terminates distally from the torso 122 at a highly-elastic cuff 142. In FIG. 11, the left sleeve 123 is bunched up, such that the full length L is not shown relative to the length of the arm of the person 111. However, FIG. 12 shows the extended (but not stretched) length L. This length L is greater than the arm length of the person 111. Indeed, the length L is quite large; it is approximately twenty-five inches and is approximately five times the neck diameter D. The cuff 142 constricts to tightly conform to the wrist of the person 111. The cuff 142 has a length C which is approximately two inches. The length C of the cuff 142 is approximately 0.6 times the neck diameter D.

The left sleeve 123 is sewn to the body 112 at a sleeve hole or opening 143 which is extremely large. The sleeve opening 143 is disproportionately large with respect to the person 111, which causes the left sleeve 123 to be disproportionately large as well. The sleeve opening 143 has a height H (shown in FIG. 12) between the top 140 and bottom 141 of the left sleeve 123 which is approximately fifteen inches. The diameter D of the neck opening 150 is approximately one-third of the height H of the sleeve opening 143. This allows the person 111 to move his or her arm into and out of the left sleeve 123 easily and to bend, fold, or hide his or her arm within the left sleeve 123 without getting caught by or even stretching the left sleeve 123. This also allows the person 111 to extend his or her arms through the left sleeve 123, pull them in through the left sleeve 123, or even fold them inside the left sleeve 123 comfortably. The sleeve opening 143 extends vertically from its top 140 at the shoulder seam 132 to its bottom 141. The bottom 141 of the sleeve opening 143 is approximately level with a middle of the marsupial pocket 126, as is explained more below.

The marsupial pocket 126 is carried on the outer ply 130 of the garment 110, at the front 113 thereof. The pocket 126 has a top 160, opposed diagonal sides 161 and 162, opposed short sides 163 and 164, and a bottom 165. The top 160, short sides 163 and 164, and the bottom 165 are sewn to the outer ply 130 of the garment 110, leaving the diagonal sides 161 and 162 free and open. This allows the marsupial pocket 126 to carry items therein or to receive the hands for warmth.

The marsupial pocket 126 is disposed in a relatively high position on the garment 110 relative to the top 115 and bottom 116. As seen in FIG. 11, the top 160 of the marsupial pocket 126 is well above halfway between the neck opening 150 and the bottom edge 133 at the bottom 116 of the garment 110. And the bottom 165 of the marsupial pocket 126 is spaced approximately one-quarter the height of the garment 110 from the bottom 116. Further, the top 160 of the marsupial pocket 126 is above the bottom 141 of each of the left and right sleeves 123 and 124, and the bottom 165 of the marsupial pocket 126 is below the bottom 141 of each of the left and right sleeves 123 and 124. This is a raised position of the marsupial pocket 126 with respect to conventional "hoodie"-style sweatshirts and provides unique features as described later. The top 160 of the marsupial pocket 126 is approximately nine inches from the bottom of the neck opening 150, and the bottom 165 of the marsupial pocket 126 is approximately thirty-one inches from the bottom edge 133 of the front 113 of the garment 110, and the marsupial pocket 126 has a height P which is approximately eleven inches. This height P is approximately 1.2 times the distance between the neck opening 150 and the top 160 of the marsupial pocket 126. Further, the height B between the neck opening 150 and the bottom edge 133 is approximately 4.6 times the height P of the marsupial pocket 126, and a distance between the neck opening 150 and the bottom edge 133 of the back 114 of the torso 122 is approximately 5.4 times the height P of the marsupial pocket 126.

As should now be clear, the garment 110 is quite large, and as shown in FIGS. 11 and 20 is useful both as an over-garment similar to a jacket and as a blanket, under which the body can be curled up for warmth and coziness. The disproportionate sizes of the various parts of the garment 110 allow it to be worn, placed, or draped over one's whole body for full-body comfort and coziness. The garment 110 is worn on the body of the person 111 like an article of clothing: the torso 22 is placed over the person's torso, their left arm is extended through the left sleeve 123, their right arm is extended through the right sleeve 124, and the hood 125 is placed over the person's head.

Even though the garment 110 is worn like a typical article of clothing, it is much different. The body 112 is considerably wider than a conventional article of clothing, being approximately three to four times wider and approximately two to three times longer. The sleeve openings 143 and 143' are at least twice as large as those on a typical article of clothing. This, in part, allows the person 111 to drape the garment 110 like a blanket when worn, and to even cover the person 111 when in a fetal position, as shown in FIG. 20, or to bring his or her arms into and out of the left and right sleeves 123 and 124 easily and without stretching the left and right sleeves 123 and 124.

The person 111 can also bunch up the left and right sleeves 123 and 124 and place his or her hands into the marsupial pocket 126 for warmth without stretching his or her arms far down, since the marsupial pocket 126 is disposed at an elevated position with respect to the bottom edge 133 of the garment 110. And, when the person 111 is crouched in the fetal position as in FIG. 20, the marsupial pocket 126 is disposed in front of the person's knees, rather than at his or her shins or feet, so that the person 111 can easily reach around the knees and place his or her hands within the marsupial pocket 126, even holding the knees at the same time. In other words, when the garment 110 is worn and the person 111 is in a fetal position, the marsupial pocket 126 is disposed in front of the knees of the person 111. Further, the tail 134 of the garment 110, because it is elongated and extends further down than the bottom edge 133 at the front 113, does not expose the buttocks or back of the person 111, but rather covers the rear of the person 111 fully. As such, when the person 111 is in the fetal position, the bottom edge 133 does extend fully to cover the person 111 entirely around. It is the particular sizes, arrangements, and proportions of the garment 110 and its constituent structural elements and features, as described above, which create these features and advantages that are not available in the prior art. Indeed, because of the differences in structural elements and features described in the many paragraphs above, the product disclosed here has experienced tremendous first-year global sales and has been copied across the world. Consumers and the competition have adopted this garment 110 as one which is different, which is different in unique ways, and which offers unique features not available in other garments or blankets.

In some embodiments of the garment 110, an interior pocket 170 is attached to the inner ply 131. As seen in FIG. 20, the pocket 170 has a top 171, an opposed bottom 172, and opposed sides 173 and 174. The bottom 172 is sewn along and into the bottom edge 133 between the sides 173 and 174. The sides 173 and 174 are sewn in parallel fashion, extending upwardly from the bottom edge 133 to the top 171. In this way, the bottom 172 and the sides 173 and 174 define closed edges of the interior pocket 170. The top 171 is not sewn onto the inner ply 131, so that the top 171 defines an opening into the interior pocket 170. The opening at the top 171 receives the feet of the person 11, as shown in FIG. 20, when the person is in a fetal or crouched position. This keeps his or her feet extra warm.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof, and no other elements or features. To the extent that modifications do not depart from the spirit of the invention, they are intended to be included within the scope thereof.

The invention claimed is:

1. An overgarment comprising:

a single body constructed from two soft, woven fabric plies;

a torso in the body, the torso having a neck opening;

opposed sleeves attached to the torso at sleeve openings, the sleeves each having a top, an opposed bottom, and a length;

a marsupial pocket having a top and opposed bottom, wherein the top of the marsupial pocket is above the bottom of each sleeve at the respective sleeve opening, and the bottom of the marsupial pocket is below the bottom of each sleeve at the respective sleeve opening;

wherein the marsupial pocket has a height between its top and bottom which is 1.2 times the distance between the neck opening and the top of the marsupial pocket.

2. The overgarment of claim 1, further comprising:

the torso has a neck opening with a neck diameter which is one-third of a height of one of the sleeve openings, wherein the height of the one of the sleeve openings is measured between the top and bottom of the one of the sleeves at the respective sleeve opening;

the torso has a width measured between the sleeve openings at the bottoms of the opposed sleeves, wherein the width is 7.4 times the neck diameter; and the length of each of the sleeves is five times the neck diameter.

3. The overgarment of claim 2, wherein each opposed sleeve terminates in a cuff having a length which is 0.6 times the neck diameter.

4. The overgarment of claim 1, further comprising:

the torso has a front and an opposed back, each having a bottom edge;

the marsupial pocket is attached to the front of the torso; and the bottom edge of the back of the torso is a convex extension below the bottom edge of the front of the torso.

5. The overgarment of claim 1, wherein:

the two fabric plies of the body define inner and outer plies of the body;

the outer ply is constructed from a low-pile knit;

the inner ply is constructed from a high-pile knit; and the two fabric plies of the body are elastic, and an edge along a bottom of the body is inelastic.

6. An overgarment comprising:

a single body constructed from two fabric plies defining inner and outer plies of the body;

a torso in the body, the torso having a neck opening;

opposed sleeves extending from the torso at sleeve openings, the sleeves each having a top and an opposed bottom;

a marsupial pocket on the outer ply, the marsupial pocket having a top and an opposed bottom, wherein the top of the marsupial pocket is above the bottom of each sleeve at the respective sleeve opening, and the bottom of the marsupial pocket is below the bottom of each sleeve at the respective sleeve opening;

wherein the marsupial pocket has a height between its top and bottom which is 1.2 times the distance between the neck opening and the top of the marsupial pocket.

7. The overgarment of claim 6, further comprising:

the torso has a neck opening with a neck diameter which is one third of a height of one of the sleeve openings, wherein the height of the one of the sleeve openings is measured between the top and bottom of the one of the sleeves at the respective sleeve opening;

the torso has a width measured between the sleeve openings at the bottoms of the opposed sleeves, wherein the width is 7.4 times the neck diameter; and the length of each of the sleeves is five times the neck diameter.

8. The overgarment of claim 7, wherein each opposed sleeve terminates in a cuff having a length which is 0.6 times the neck diameter.

9. The overgarment of claim 6, further comprising:

the torso has a front and an opposed back, each having a bottom edge;

the marsupial pocket is attached to the front of the torso; and the bottom edge of the back of the torso is convex extension below the bottom edge of the front of the torso.

10. The overgarment of claim 6, wherein:

the outer ply is constructed from a low-pile knit;

the inner ply is constructed from a high-pile knit; and the two fabric plies of the body are elastic, and an edge along a bottom of the body is inelastic.

11. An overgarment comprising:

a single body constructed from two fabric plies defining inner and outer plies of the body;

a torso in the body, the torso including a neck opening having a neck diameter;

opposed sleeves extending from the torso at sleeve openings, the sleeves each having a top, an opposed bottom, and a length;

the torso has a width measured between the sleeve openings at the bottoms of the opposed sleeves; and a marsupial pocket on the outer ply, the marsupial pocket having a top and an opposed bottom, wherein the top of the marsupial pocket is above the bottom of each sleeve at the respective sleeve opening, and the bottom of the marsupial pocket is below the bottom of each sleeve at the respective sleeve opening;

wherein the neck diameter is one third of a height of the one of the sleeve openings, wherein the height of the one of the sleeve openings is measured between the top and bottom of the one of the sleeves at the respective sleeve opening;

the marsupial pocket has a height between its top and bottom which is 1.2 times the distance between the neck opening and the top of the marsupial pocket;

the width of the torso is 7.4 times the neck diameter; and the length of each of the sleeves is five times the neck diameter.

12. The overgarment of claim 11, wherein each opposed sleeve terminates in a cuff having a length which is 0.6 times the neck diameter.

13. The overgarment of claim 11, further comprising:

the torso has a front and an opposed back, each having a bottom edge;

the marsupial pocket is attached to the front of the torso; and the bottom edge of the back of the torso is a convex below the bottom edge of the front of the torso.

14. The overgarment of claim 11, wherein:

the outer ply is constructed from a low-pile knit;

the inner ply is constructed from a high-pile knit; and the two fabric plies of the body are elastic, and an edge along a bottom of the body is inelastic.

15. The overgarment of claim 11, wherein:

the torso has a front and an opposed back, each having a bottom edge;

a distance between the neck opening and the bottom edge of the front of the torso is three times a height of the marsupial pocket between the top and bottom thereof; and a distance between the neck opening and the bottom edge of the back of the torso is 3.7 times a height of the marsupial pocket between the top and bottom thereof.

16. The overgarment of claim 11, wherein:

the torso has a front and an opposed back, each having a bottom edge;

a distance between the neck opening and the bottom edge of the front of the torso is 4.6 times a height of the marsupial pocket between the top and bottom thereof; and a distance between the neck opening and the bottom edge of the back of the torso is 5.4 times a height of the marsupial pocket between the top and bottom thereof.

* * * * *